US010232653B2

(12) United States Patent
Sawai et al.

(10) Patent No.: US 10,232,653 B2
(45) Date of Patent: Mar. 19, 2019

(54) PRINTING APPARATUS

(71) Applicant: SEIKO EPSON CORPORATION, Tokyo (JP)

(72) Inventors: Mikinori Sawai, Matsumoto (JP); Susumu Taga, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/840,824

(22) Filed: Dec. 13, 2017

(65) Prior Publication Data

US 2018/0178566 A1 Jun. 28, 2018

(30) Foreign Application Priority Data

Dec. 27, 2016 (JP) ..... 2016-254073

(51) Int. Cl.

| | |
|---|---|
| ***B41J 29/02*** | (2006.01) |
| ***B41J 2/175*** | (2006.01) |
| ***B41J 29/13*** | (2006.01) |
| *B41J 2/01* | (2006.01) |

(52) U.S. Cl.

CPC ..... *B41J 29/02* (2013.01); *B41J 2/1752* (2013.01); *B41J 2/17509* (2013.01); *B41J 2/17553* (2013.01); *B41J 29/13* (2013.01); *B41J 2/01* (2013.01)

(58) Field of Classification Search

CPC .... B41J 2/175; B41J 2/17503; B41J 2/17509; B41J 2/1752; B41J 2/17522; B41J 29/02

See application file for complete search history.

(56) References Cited

U.S. PATENT DOCUMENTS

| | | | | |
|---|---|---|---|---|
| 7,416,290 | B2 * | 8/2008 | Hattori | B41J 2/17513 347/19 |
| 7,712,882 | B2 * | 5/2010 | Silverbrook | B41J 2/04541 347/42 |
| 8,042,925 | B2 * | 10/2011 | Sugahara | B41J 2/17566 347/86 |
| 8,353,585 | B2 * | 1/2013 | Harada | B41J 2/1721 347/36 |
| 2007/0165084 | A1 | 7/2007 | Yano | |

FOREIGN PATENT DOCUMENTS

| | | |
|---|---|---|
| JP | 2007-268981 | 10/2007 |

* cited by examiner

*Primary Examiner* — Anh T Vo
(74) *Attorney, Agent, or Firm* — Workman Nydegger

(57) ABSTRACT

An ink jet type printer includes a liquid discharge head that prints on a sheet, a container that houses ink, and a mounting portion which has an insertion opening and to which the container inserted through the insertion opening is detachably mounted. The mounting portion includes a mounting portion-side rib that, when the container is to be inserted through the insertion opening, guides the container to the insertion opening.

18 Claims, 6 Drawing Sheets

PRINTING APPARATUS

CROSS REFERENCES TO RELATED APPLICATION

The entire disclosure of Japanese Patent Application No. 2016-254073, filed Dec. 27, 2016, is expressly incorporated by reference herein.

BACKGROUND

1. Technical Field

The present disclosure relates to a printing apparatus, for example, an ink jet type printer.

2. Related Art

An ink jet type printer, a widely known printing apparatus, ejects ink from the nozzles of a recording head to perform printing on a sheet. This type of printer is equipped with an ink cartridge housing apparatus that houses an ink cartridge filled with an ink that is to be supplied to the recording head (see, e.g., JP-A-2007-268981).

The ink cartridge housing apparatus includes a housing case body capable of housing a rectangular box-shaped ink cartridge and a lid that opens and closes a front surface opening of the housing case body. The housing case body has a housing chamber into which the ink cartridge is removably inserted through the front surface opening.

Usually in the above-described printer, the front surface opening of the housing case body of the ink cartridge housing apparatus has a pre-set size that just allows insertion of an ink cartridge. Therefore, when inserting an ink cartridge into the housing chamber of the housing case body through the front surface opening, a user or the like may sometimes catch the ink cartridge on the open lid or knock the ink cartridge on a wall that partially forms the front surface opening. Thus, there is room for improvement regarding smooth insertion of the ink cartridge into the housing chamber through the front surface opening.

SUMMARY

An advantage of some aspects of the disclosure is that a printing apparatus that allows a container that houses a print-related member to be smoothly inserted into an opening of a mounting portion is provided.

Configurations of printing apparatuses according to the disclosure and operation and effects thereof will be described below.

One aspect of the disclosure provides a printing apparatus that includes a printing section that prints on a medium, a container that houses a print-related member related to printing performed by the printing section, and a mounting portion which has an opening and to which the container inserted through the opening is detachably mounted. The mounting portion includes a guiding portion that guides the container to the opening when the container is inserted through the opening.

According to this aspect of the disclosure, when the container in which the print-related member is housed is to be mounted to the mounting portion, the container is guided to the opening by the guiding portion. Therefore, the container in which the print-related member is housed can be smoothly inserted into the opening of the mounting portion.

In the foregoing printing apparatus, the guiding portion may have a mounting portion-side inclined surface that guides the container to the opening.

According to this embodiment, by sliding the container on the mounting portion-side inclined surface toward the opening, the container can be smoothly inserted into the opening of the mounting portion.

In the printing apparatus of the foregoing aspect of the disclosure, the guiding portion may be provided at a location below the opening and the mounting portion-side inclined surface may be inclined so as to become higher toward the opening.

According to this embodiment, by sliding the container on the mounting portion-side inclined surface from a location below the opening toward the opening, the container can be smoothly inserted into the opening of the mounting portion even when the container is heavy.

In the printing apparatus of the aspect of the disclosure, the guiding portion may have at least one mounting portion-side rib that has the mounting portion-side inclined surface.

According to this embodiment, the mounting portion-side rib reinforces the mounting portion and the mounting portion-side inclined surface of the mounting portion-side rib guides the container toward the opening.

In the foregoing embodiment of the printing apparatus, the container may include a false mount-inhibiting protrusion that inhibits false mounting to the mounting portion, the mounting portion may include a false mount-inhibiting recess portion that receives the false mount-inhibiting protrusion when the container is mounted to the mounting portion, and the mounting portion-side rib may be disposed at such a location as not to correspond to the false mount-inhibiting recess portion in a mounting direction in which the container is mounted to the mounting portion.

According to this embodiment, it is possible to inhibit the false mount-inhibiting protrusion of the container from colliding with a mounting portion-side rib at the time of mounting the container to the mounting portion.

In the foregoing embodiment, the mounting portion may include a plurality of unit mounting portions, and locations of the false mount-inhibiting recess portions provided for the plurality of unit mounting portions may be different from one unit mounting portion to another.

According to this embodiment, because the false mount-inhibiting protrusions of a plurality of containers can be provided so as to correspond one-to-one to the false mount-inhibiting recess portions the plurality of unit mounting portions, it is possible to inhibit a container from being falsely mounted to a unit mounting portion that does not correspond to that container.

The foregoing printing aspect of the aspect of the disclosure may further include an opening/closing cover that covers the mounting portion in an easily openable/closable manner, and the opening/closing cover may have a cover-side inclined surface that, during an open state of the opening/closing cover, guides the container to the mounting portion-side inclined surface.

According to this embodiment, by sliding the container on the cover-side inclined surface toward the mounting portion-side inclined surface, the container can be guided to the mounting portion-side inclined surface.

In the foregoing embodiment of the printing apparatus, the opening/closing cover may include at least one cover-side rib that has the cover-side inclined surface.

According to this embodiment, the cover-side rib reinforces the opening/closing cover and the cover-side inclined surface of the cover-side rib guides the container to the mounting portion-side inclined surface.

In the foregoing embodiment, the opening/closing cover may be disposed so that, during the open state of the opening/closing cover, an end portion of the opening/closing cover at a side in a mounting direction in which the container is mounted to the mounting portion overlaps a portion of the mounting portion when viewed in a vertical direction.

According to this embodiment, the distance between the cover-side inclined surface and the mounting portion-side inclined surface can be made shorter.

In the foregoing embodiment, during the open state of the opening/closing cover, the cover-side rib may be located at a side in a direction opposite to the mounting direction from a portion of the opening/closing cover which, when viewed in the vertical direction, coincides with a portion of the mounting portion.

According to this embodiment, it is possible to inhibit the cover-side rib from coming into contact with a portion of the mounting portion when the opening/closing cover is opened or closed.

In the foregoing embodiment, the opening/closing cover may be opened and closed by pivoting the opening/closing cover about a pivot shaft.

This embodiment requires less space than, for example, a configuration in which the opening/closing cover is opened and closed by sliding the opening/closing cover.

In the foregoing printing apparatus of the aspect of the disclosure, the printing section may be a liquid discharge head that ejects a liquid to the medium and the container may be a liquid storing container that includes a housing portion that detachably houses a liquid container that stores the liquid that is to be supplied to the liquid discharge head.

According to this embodiment, printing can be carried out on the medium by ejecting the liquid supplied from the liquid storing container from the liquid discharge head to the medium.

Another aspect of the disclosure provides a printing apparatus that includes a printing section that prints on a medium, a container that houses a print-related member related to printing performed by the printing section, a mounting portion which has an opening and to which the container inserted through the opening is detachably mounted, an opening/closing cover that covers the mounting portion in an easily openable/closable manner. At least one of the mounting portion and the opening/closing cover includes a guiding portion that, when the container is to be inserted through the opening, guides the container to the opening.

According to this aspect of the disclosure, when the container in which the print-related member is housed is to be mounted, the container is guided to the opening by the guiding portion. Therefore, the container in which the print-related member is housed can be smoothly inserted into the opening of the mounting portion.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

An exemplary embodiment of in which the printing apparatus of the disclosure is embodied as an ink jet type printer will be described below.

Figure 1:
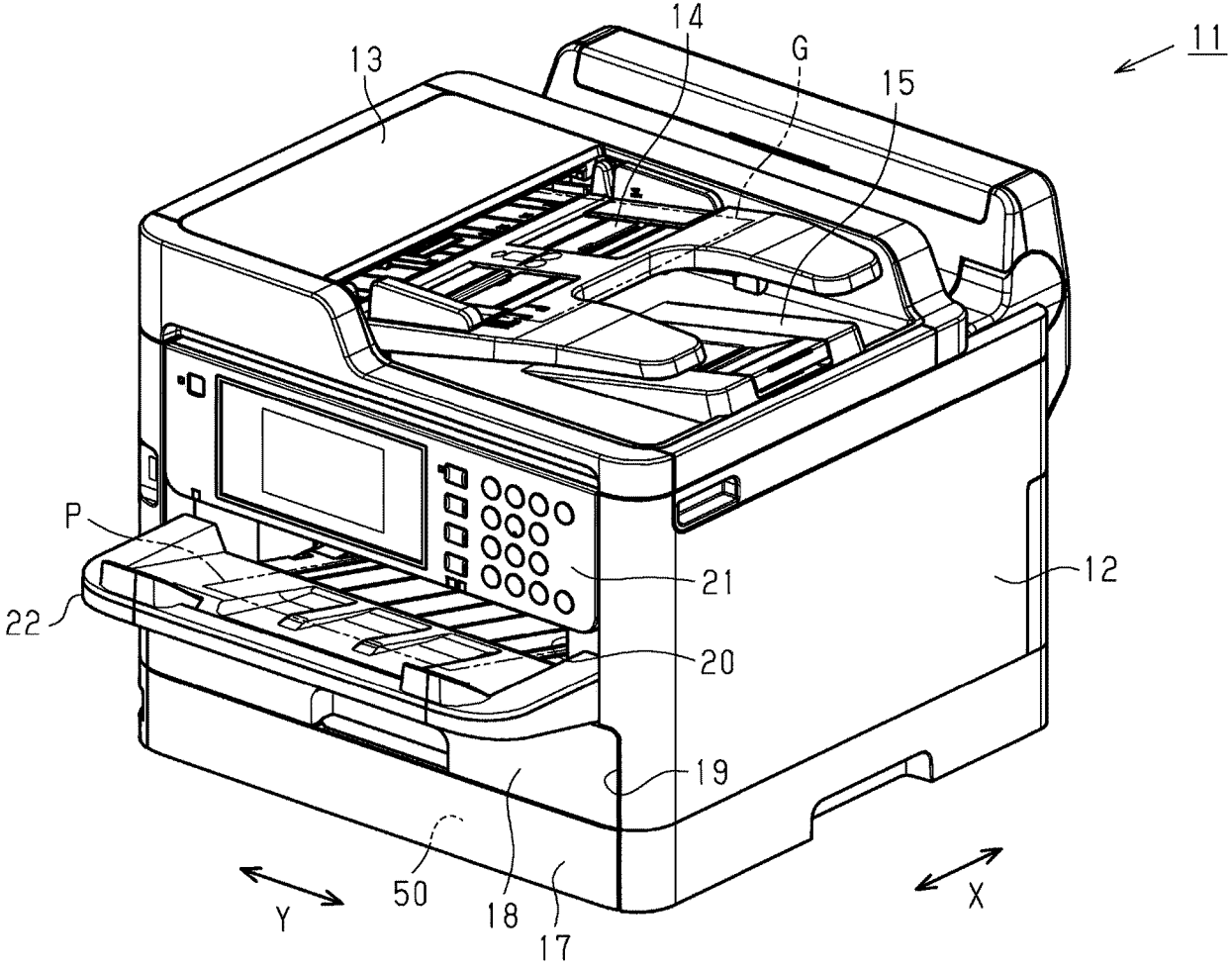
FIG. 1 is a perspective view of an ink jet type printer according to an exemplary embodiment of the disclosure.

As illustrated in FIG. 1, an ink jet type printer 11, an example of the printing apparatus, includes a casing 12 that has predetermined measures of height, depth, and width when installed in a horizontal place of use and a document reader apparatus that includes an automatic document feeder apparatus 13 disposed on the casing 12.

The automatic document feeder apparatus 13 includes a document setting section 14 in which a plurality of documents G can be set in a stacked state, and also includes a discharge section 15 disposed under the document setting section 14. Then, the documents G in a stack set in the document setting section 14 are sequentially read by the reader section 16 (see FIG. 2) disposed at an upper end portion in the casing 12, while being inverted and transported to the discharge section 15 through a document feed path (not depicted).

A front surface portion of the casing 12 is provided with an opening/closing cover 17, a mounting opening 19 to which a sheet cassette 18 that houses sheets P of paper, an example of a medium, is easily detachably mounted, a discharge port 20 via which printed sheets P are sent out, and an operation section 21 for performing various operations, in that order from a bottom side to an upper side. Furthermore, a discharge tray 22 that supports printed sheets P sent out via the discharge port 20 is detachably mounted to the front surface portion of the casing 12 so that the discharge tray 22 is protruded forward from the front surface portion. Note that the front surface of the casing 12 refers to a side surface thereof which has a height and a width and on which a user operates the ink jet type printer 11.

Figure 2:
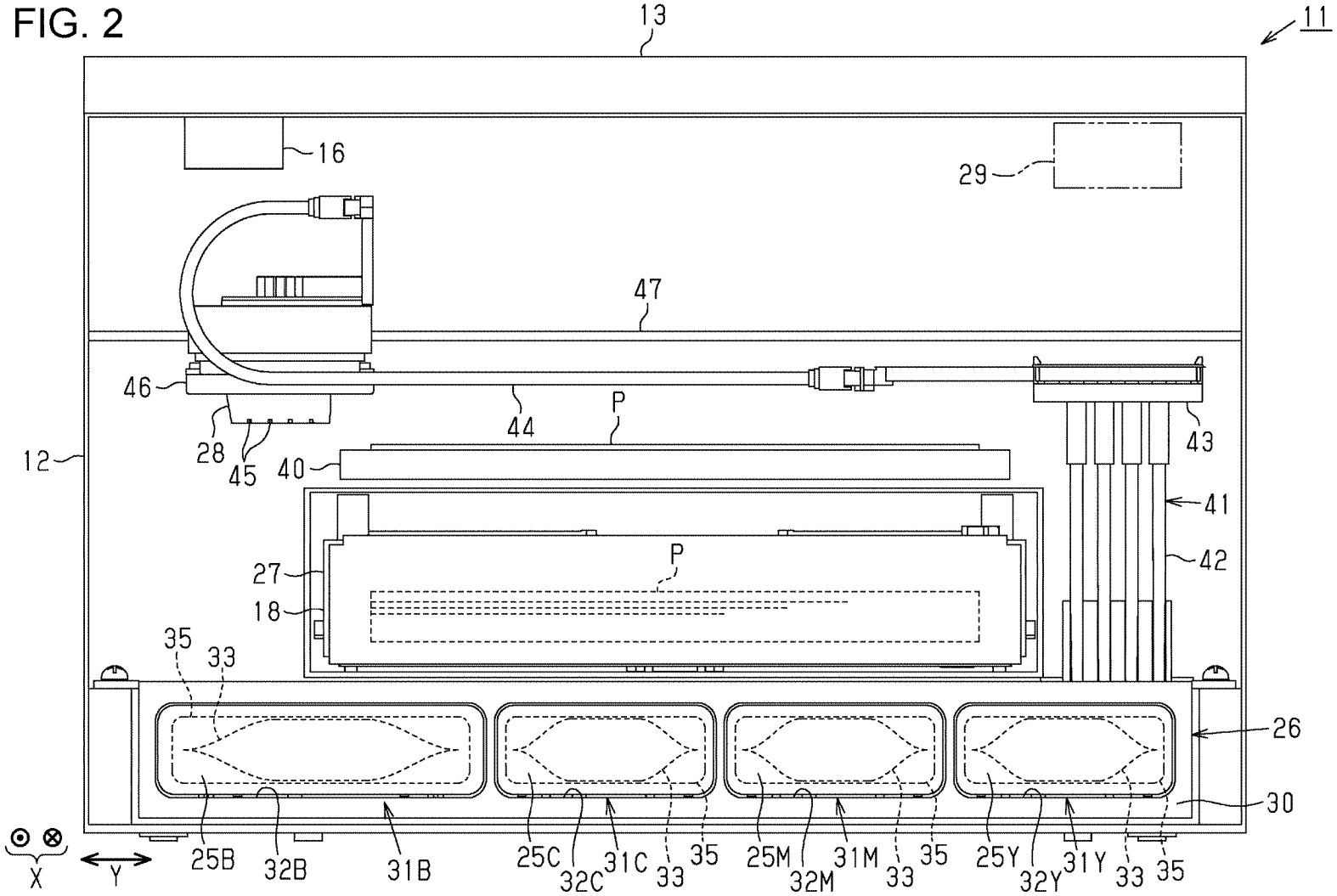
FIG. 2 is a front schematic diagram illustrating an internal structure of the ink jet type printer.

As illustrated in FIGS. 1 and 2, the casing 12 houses, at locations therein at an inner side (i.e., a far side from front to rear) of the opening/closing cover 17, the mounting opening 19, and the operation section 21, a mounting portion 26 to which containers 25B, 25C, 25M and 25Y are detachably mounted, a sheet housing portion 27 that houses sheets P that are housed in the sheet cassette 18, and a liquid discharge head 28 that is an example of a printing section that performs printing on a sheet P. The opening/closing cover 17 covers a front surface of the mounting portion 26 so as to be capable of being easily opened and closed. Furthermore, the ink jet type printer 11 includes at a location within the casing 12 a control section 29 that performs overall control of the entire ink jet type printer 11.

As illustrated in FIG. 2, the mounting portion 26 includes a frame 30 that forms a housing space capable of housing a plurality of (four in this exemplary embodiment) containers 25B, 25C, 25M and 25Y and a plurality of (four in this exemplary embodiment) unit mounting portions 31B, 31C, 31M and 31Y to which the containers 25B, 25C, 25M and 25Y are detachably mounted, respectively. The unit mounting portions 31B, 31C, 31M and 31Y include insertion openings 32B, 32C, 32M and 32Y, respectively, as an example of a plurality of (four in the exemplary embodiment) openings formed in the frame 30.

The insertion openings 32B, 32C, 32M and 32Y communicate with housing spaces from the near side in FIGS. 1 and 2 in depth directions X. The four containers 25B, 25C, 25M and 25Y are detachably mounted to the unit mounting portions 31B, 31C, 31M and 31Y by inserting the containers 25B, 25C, 25M and 25Y into the four insertion openings 32B, 32C, 32M and 32Y, respectively.

Note that, in this exemplary embodiment, the directions in which the containers 25B, 25C, 25M and 25Y are inserted into and withdrawn from the insertion openings 32B, 32C, 32M and 32Y are the depth directions X, and directions orthogonal to the depth directions X are lateral directions Y. The lateral directions Y and the depth directions X are substantially along a horizontal plane. The insertion openings 32B, 32C, 32M and 32Y are disposed side by side along the lateral directions Y. The insertion opening 32B is larger in size than the insertion openings 32C, 32M and 32Y. The insertion openings 32C, 32M and 32Y are the same in size and shape.

Figure 3:
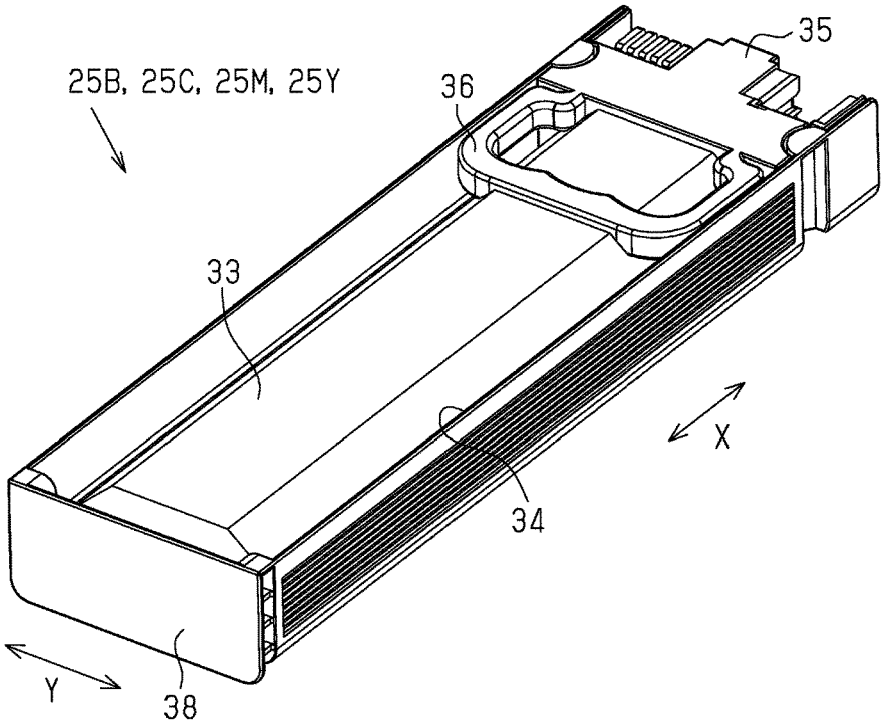
FIG. 3 is a perspective view of a container taken from above.

As illustrated in FIGS. 2 and 3, the containers 25B, 25C, 25M and 25Y in this exemplary embodiment have a substantially bottomed rectangular box shape and are liquid storing containers that each include a housing portion 34 in which a flexible bag 33, an example of a liquid container, that stores an ink (liquid), an example of a print-related member that is related to the printing performed by the liquid discharge head 28, is removably housed.

The bag 33 of each of the container 25B, 25C, 25M and 25Y stores the ink that is to be supplied to the liquid discharge head 28. The bag 33 is provided with a connecting portion 35 and a handle 36. The connecting portion 35 of each bag 33, when the bag 33 is housed in the housing portion 34 of a corresponding one of the containers 25B, 25C, 25M and 25Y, is exposed on an end side of the container 25B, 25C, 25M or 25Y in its length directions, which coincide with the depth directions X. When the containers 25B, 25C, 25M and 25Y are mounted to the unit mounting portions 31B, 31C, 31M and 31Y, respectively, the connecting portions 35 of the containers 25B, 25C, 25M and 25Y are connected to the unit mounting portions 31B, 31C, 31M and 31Y, respectively.

Figure 4:
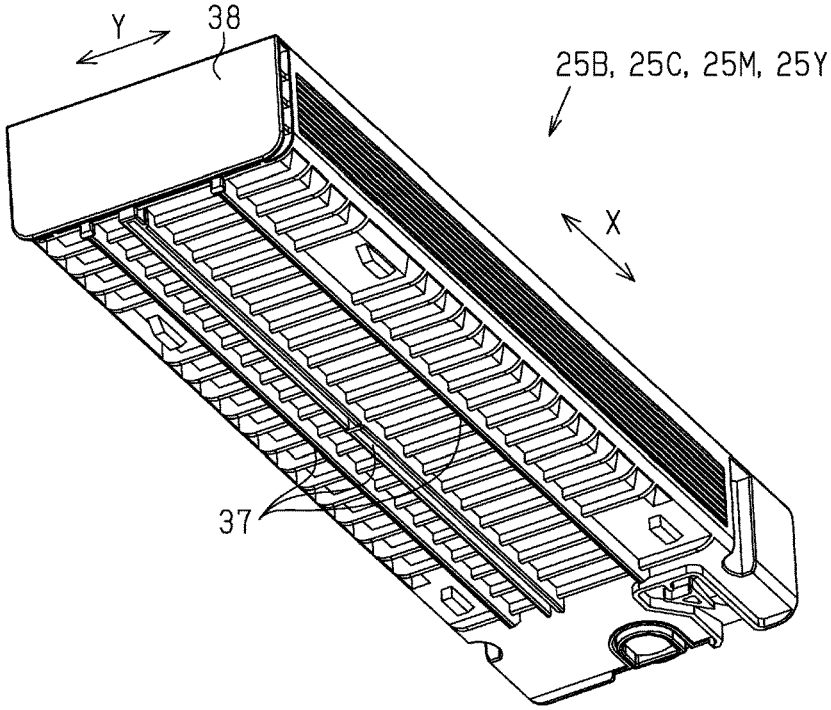
FIG. 4 is a perspective view of the container taken from below.

As illustrated in FIGS. 2 and 4, a reverse side of each of the containers 25B, 25C, 25M and 25Y (the opposite side thereof to the housing portion 34 side) is provided with a plurality of (three in this exemplary embodiment) false mount-inhibiting protrusions 37 that extend in the depth directions X. The three false mount-inhibiting protrusions 37 of each container 25B, 25C, 25M or 25Y extend in parallel with each other, with spaces left therebetween in the lateral directions Y, so that the containers 25B, 25C, 25M and 25Y are inhibited from being falsely mounted to the unit mounting portions 31B, 31C, 31M and 31Y. In this exemplary embodiment, the three false mount-inhibiting protrusions 37 of the container 25B are arranged differently from the three false mount-inhibiting protrusions 37 of each of the containers 25C, 25M and 25Y. The containers 25C, 25M and 25Y have the same arrangement of the false mount-inhibiting protrusions 37.

An end portion of each of the containers 25B, 25C, 25M and 25Y on the opposite side thereof to the exposed connecting portion 35 is provided with a substantially rectangular platy design portion 38 that is in accord with a corresponding one of the insertion openings 32B, 32C, 32M and 32Y. The containers 25B, 25C, 25M and 25Y are each configured so that the three false mount-inhibiting protrusions 37 are not visible from the design portion 38 side. That is, each container 25B, 25C, 25M or 25Y is configured so that, in a view from the design portion 38 side, the three false mount-inhibiting protrusions 37 are hidden by the design portion 38.

The bags 33 housed in the four containers 25B, 25C, 25M and 25Y store inks that are different in color from each other (black, cyan, magenta, and yellow in this exemplary embodiment). In this case, since black ink is highly frequently used, the bag 33 that stores the black ink and the container 25B that houses the black-ink bag 33 are made larger in size than the bags 33 that store the inks (the cyan ink, the magenta ink, and the yellow ink) other than the black ink and the containers 25C, 25M and 25Y that house these bags 33.

The bags 33 that store the cyan ink, the magenta ink, and the yellow ink and the containers 25C, 25M and 25Y that house these bags 33 are respectively the same in size. In this exemplary embodiment, the container 25B that houses the bag 33 that stores the black ink is inserted into the insertion opening 32B that is located at a left end in FIG. 2.

Furthermore, in FIG. 2, the container 25C for the cyan ink is inserted into the insertion opening 32C that is disposed immediately to the right of the insertion opening 32B, the container 25M for the magenta ink is inserted into the insertion opening 32M that is disposed immediately to the right of the insertion opening 32C, and the container 25Y for the yellow ink is inserted into the insertion opening 32Y that is disposed immediately to the right of the insertion opening 32M. The sizes and shapes of the insertion openings 32B, 32C, 32M and 32Y are in accord with the sizes and shapes of the containers 25B, 25C, 25M and 25Y that are inserted into the insertion openings 32B, 32C, 32M and 32Y.

As illustrated in FIG. 2, within the casing 12, a support table 40 that supports a sheet P is disposed above the sheet housing portion 27. The sheets P in a stack housed in the sheet housing portion 27 are inverted and transported one at a time onto a top surface of the support table 40 by a transporting section (not depicted). Furthermore, the casing 12 houses therein supply mechanisms 41 that supply the inks from the containers 25B, 25C, 25M and 25Y mounted to the unit mounting portions 31B, 31C, 31M and 31Y to the liquid discharge head 28 by driving a supply pump (not depicted).

Each supply mechanism 41 includes a supply tube 42 that is connected at an end side to the unit mounting portion 31B, 31C, 31M or 31Y, a joint portion 43 that is connected to the other end side of the supply tube 42, and a flexible tube 44 that is connected at an end side thereof to the joint portion 43 and connected at the other end side to the liquid discharge head 28. In this exemplary embodiment, four supply mechanisms 41 are disposed within the casing 12, corresponding to the four containers 25B, 25C, 25M and 25Y.

The liquid discharge head 28 includes a plurality of nozzles 45 that eject corresponding ones of the inks supplied from the containers 25B, 25C, 25M and 25Y via the connecting portions 35 and the supply mechanisms 41. The liquid discharge head 28 is supported by a carriage 46. The carriage 46 is supported on a guide shaft 47 that spans an interior of the casing 12 and extends in the lateral directions Y in such a manner that the carriage 46 is movable back and forth. That is, the carriage 46 is moved back and forth in the lateral directions Y.

Printing is performed on a sheet P by causing the liquid discharge head 28 to eject the inks from the nozzles 45 to the sheet P transported onto the support table 40 while moving the carriage 46 back and forth in the lateral directions Y along the guide shaft 47. During printing, the flexible tubes 44 are flexibly displaced following the back and forth movements of the carriage 46. The sheet P that has been subjected to printing is sent out onto the discharge tray 22 through the discharge port 20 as illustrated in FIG. 1.

Figure 5:
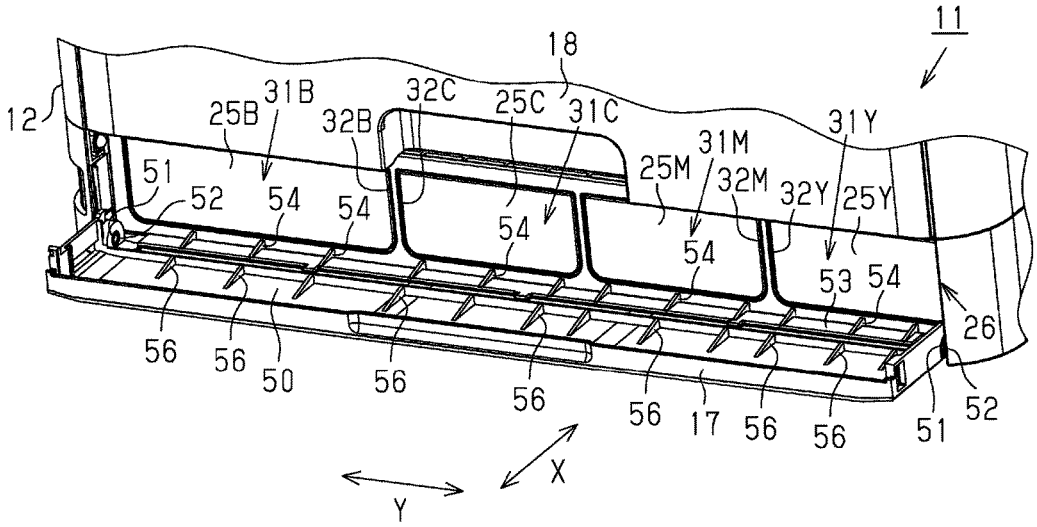
FIG. 5 is a perspective view illustrating mounting portions and their adjacent portions in the ink jet type printer.

As illustrated in FIGS. 1 and 5, the opening/closing cover 17 has a bottomed rectangular box shape elongated in the lateral directions Y. When the opening/closing cover 17 is open, only a bottom wall 50 thereof that forms a vertical surface during the closed state thereof (the state illustrated in FIG. 1) is exposed. Proximal end portions of two side walls of the opening/closing cover 17 that face each other in the lateral directions Y are provided with annular bearing portions 51 that make a pair. The casing 12 has, at locations corresponding to the two bearing portions 51, two pivot shafts 52 that are protruded in the lateral directions Y. The pivot shafts 52 are respectively inserted into the bearing portions 51.

Therefore, the opening/closing cover 17 is supported pivotably by the two pivot shafts 52 inserted into the two bearing portions 51. The opening/closing cover 17 is opened and closed by pivoting the opening/closing cover 17 about the two pivot shafts 52 between a closed position (a position indicated in FIG. 1) in which the bottom wall 50 is along a vertical plane and an open position (a position indicated in FIG. 5) which is assumed by making a 90-degree pivot from the closed state so that the bottom wall 50 is along a horizontal plane. That is, the opening/closing cover 17 is opened by pivoting it to the front side (the near side in FIG. 5) from the closed position about a pivot center that is at a lower end when the opening/closing cover 17 is closed.

Figure 6:
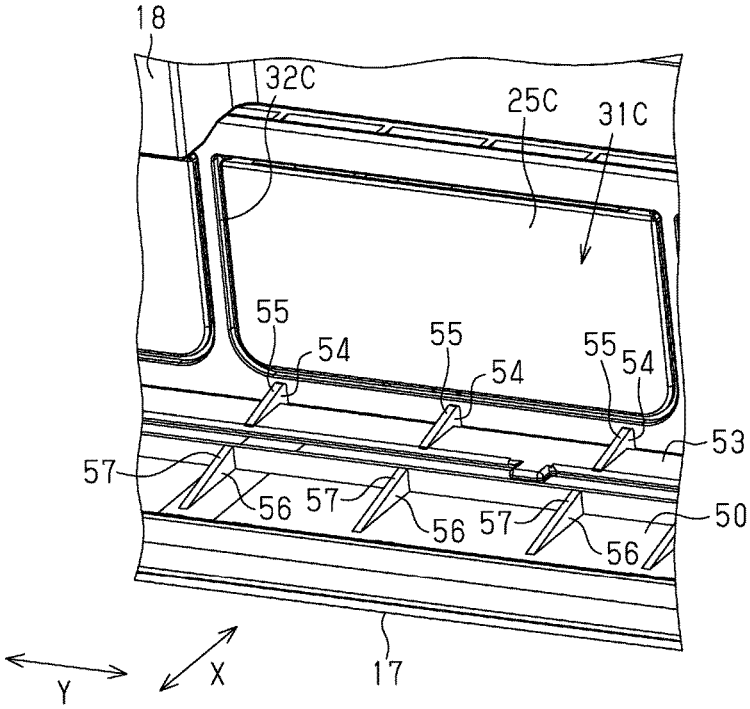
FIG. 6 is an enlarged view of a part of FIG. 5.

As illustrated in FIGS. 5 and 6, the mounting portion 26 has a rectangular platy tongue portion 53 extending in the lateral directions Y at a location on an opening/closing cover 17 side end of the mounting portion 26 which is below the insertion openings 32B, 32C, 32M and 32Y. The length of the tongue portion 53 in the lateral directions Y is pre-set so as to substantially entirely cover the insertion openings 32B, 32C, 32M and 32Y. An upper surface of the tongue portion 53 is provided with a plurality of mounting portion-side ribs 54 having a platy shape, as an example of a guiding portion that guides the containers 25B, 25C, 25M and 25Y to the insertion openings 32B, 32C, 32M and 32Y when the containers 25B, 25C, 25M and 25Y are inserted through the insertion openings 32B, 32C, 32M and 32Y.

Each mounting portion-side rib 54 has a substantially right triangle shape when viewed from a lateral direction Y, and is disposed at a location below the insertion openings 32B, 32C, 32M and 32Y. An upper surface of each mounting portion-side rib 54 is provided as a mounting portion-side inclined surface 55 that is inclined so as to have an increasing height gradient in the depth direction X toward the insertion openings 32B, 32C, 32M and 32Y. In this exemplary embodiment, the mounting portion-side ribs 54 are arranged so that each of the insertion openings 32B, 32C, 32M and 32Y faces corresponding three mounting portion-side ribs 54 in the depth directions X. The corresponding three mounting portion-side ribs 54 of each of the insertion openings 32B, 32C, 32M and 32Y are spaced from each other by appropriate intervals in lateral directions Y.

An upper surface of the bottom wall 50 during the open state where the opening/closing cover 17 is in the open position is provided with a plurality of cover-side ribs 56 having a platy shape. The cover-side ribs 56 are provided so as to align with (correspond to) the mounting portion-side ribs 54 in the depth directions X. During the open state of the opening/closing cover 17, the cover-side ribs 56 are located below the mounting portion-side ribs 54.

During the open state of the opening/closing cover 17, upper surfaces of the cover-side ribs 56 serve, due to their configuration, as cover-side inclined surfaces 57 that are inclined so as to guide the containers 25B, 25C, 25M and 25Y to the mounting portion-side inclined surfaces 55 of the mounting portion-side ribs 54 when the containers 25B, 25C, 25M and 25Y are to be inserted through the insertion openings 32B, 32C, 32M and 32Y. The cover-side inclined surfaces 57 are inclined so as to become higher toward the mounting portion-side ribs 54.

Figure 7:
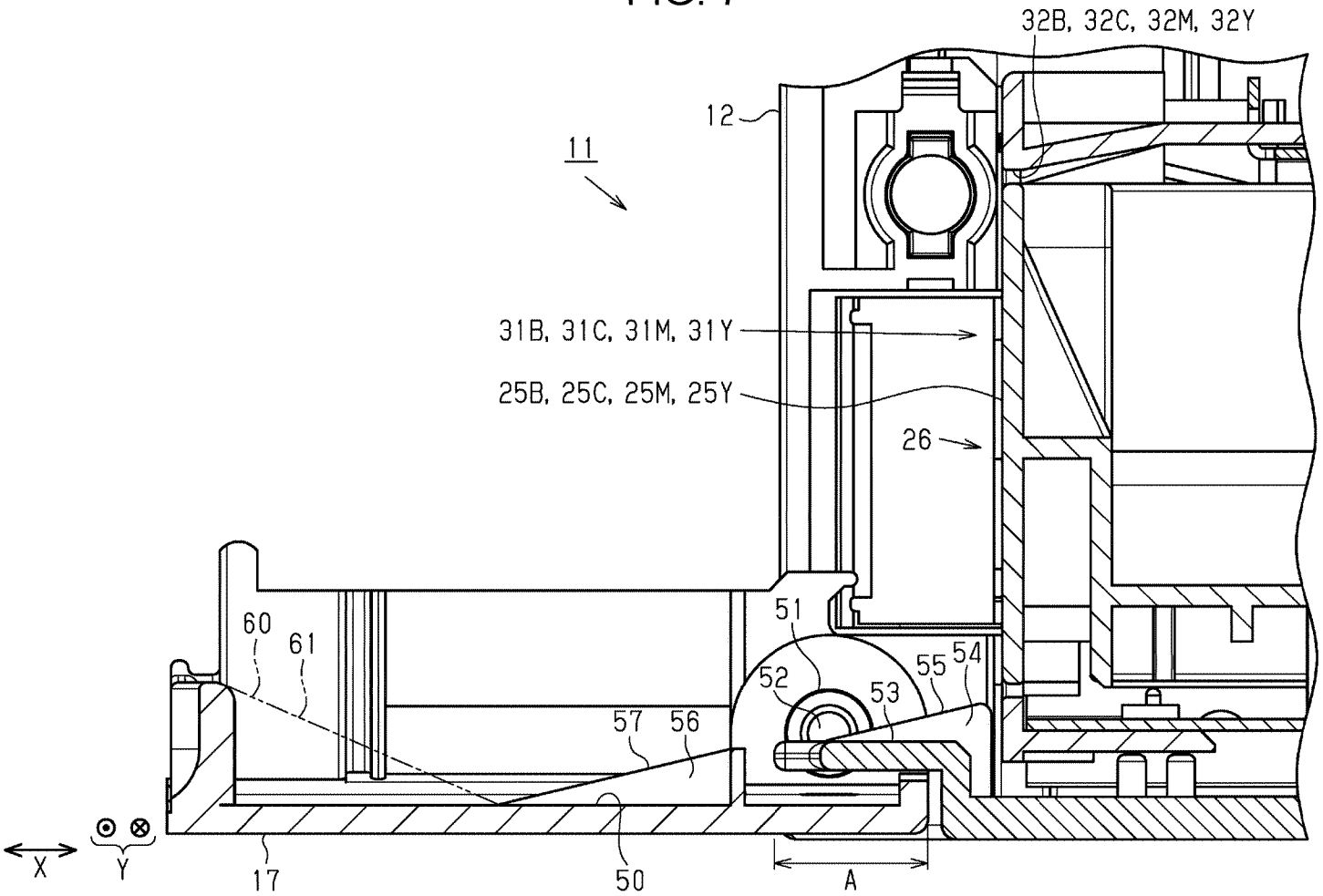
FIG. 7 is a sectional view taken from FIG. 5.

As illustrated in FIG. 7, the opening/closing cover 17 is disposed so that, during the open state, an end portion of the opening/closing cover 17 at a side (a right side in FIG. 7) in a mounting direction in which the containers 25B, 25C, 25M and 25Y are mounted to the unit mounting portions 31B, 31C, 31M and 31Y, when viewed from a vertical direction, overlaps the tongue portion 53, which is a portion of the mounting portion 26. That is, the opening/closing cover 17 is disposed so that, during the open state, the mounting portion 26-side end portion of the opening/closing cover 17 in the depth directions X overlaps the tongue portion 53 from below, at an immediately adjacent location.

With this arrangement, when the opening/closing cover 17 in the open state is further pivoted in a direction away from the closed position side, the mounting portion 26-side end portion of the opening/closing cover 17 contacts the tongue portion 53, so that such pivoting of the opening/closing cover 17 is prevented by the tongue portion 53. That is, the tongue portion 53 functions also as a stopper that, when the opening/closing cover 17 is pivoted from the closed position to the open position, restricts the pivoting of the opening/closing cover 17 within the range to the open position.

Note that the cover-side ribs 56 of the opening/closing cover 17 are located on an area to a side (the left side) of an overlap region A of the opening/closing cover 17 which, in a vertical direction, underlies the tongue portion 53, the side being in the direction opposite to the mounting direction (the rightward direction in FIG. 7) in which the containers 25B, 25C, 25M and 25Y are mounted to the unit mounting portions 31B, 31C, 31M and 31Y. That is, the cover-side ribs 56 are disposed at a location in the depth directions X that is farther from the mounting portion 26 than the region A is from the mounting portion 26 when the opening/closing cover 17 is open.

Figure 8:
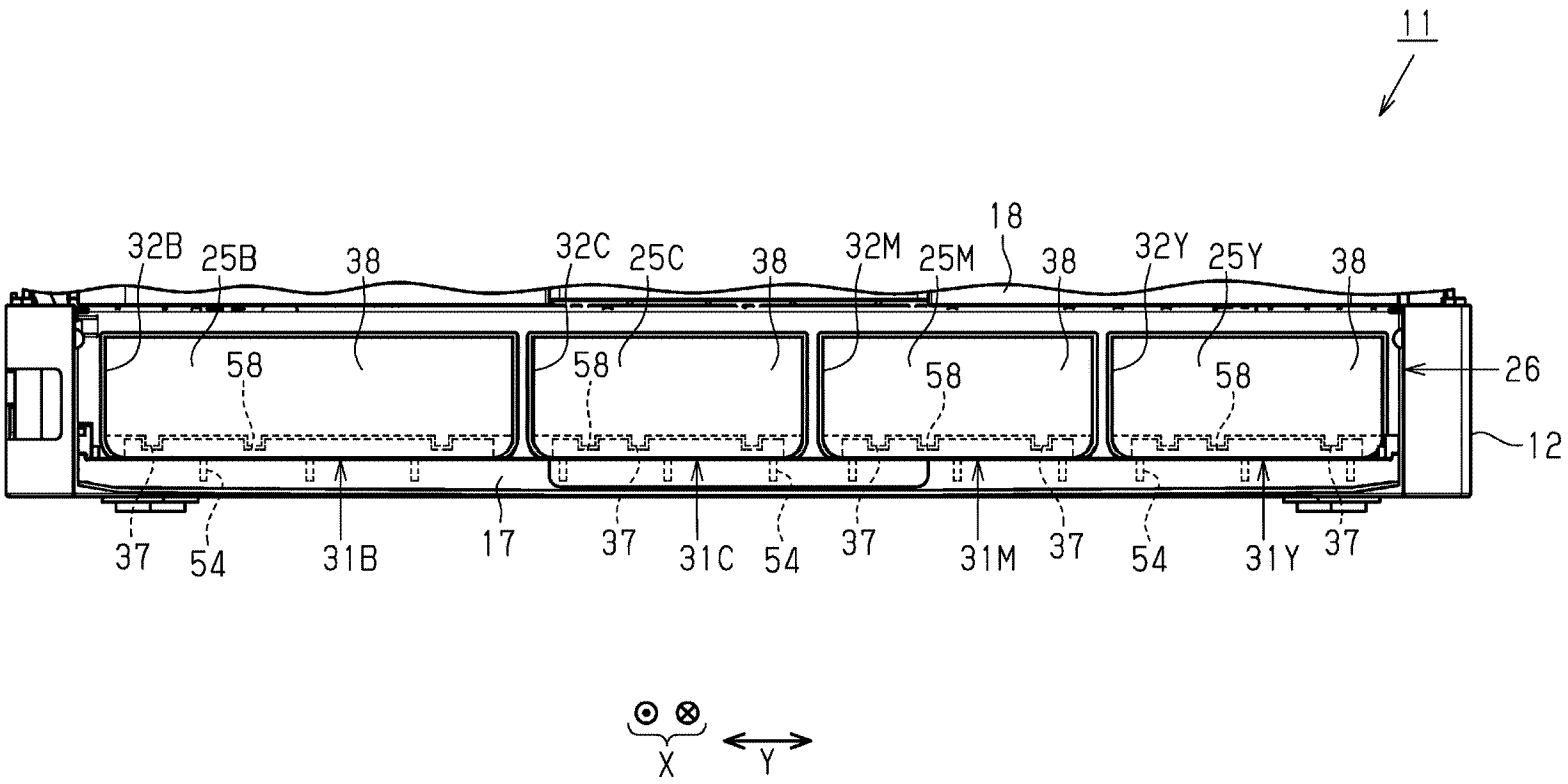
FIG. 8 is a front view illustrating the mounting portions and their adjacent portions in the ink jet type printer.

As illustrated in FIG. 8, bottom portions in the unit mounting portions 31B, 31C, 31M and 31Y have, at locations corresponding to the false mount-inhibiting protrusions 37 of the containers 25B, 25C, 25M and 25Y mounted into the unit mounting portions 31B, 31C, 31M and 31Y, groove-shaped false mount-inhibiting recesses 58 extending in the depth directions X which receive therein the false mount-inhibiting protrusions 37. That is, in this exemplary embodiment, each of the unit mounting portions 31B, 31C, 31M and 31Y is provided with three false mount-inhibiting recesses 58 that receive therein the three false mount-inhibiting protrusions 37 of a corresponding one of the containers 25B, 25C, 25M and 25Y when that corresponding container 25B, 25C, 25M or 25Y is inserted.

Therefore, this configuration inhibits the containers 25B, 25C, 25M and 25Y from being mounted to the unit mounting portions 31B, 31C, 31M and 31Y in a false posture and inhibits any one of the containers 25C, 25M and 25Y from being falsely mounted to the unit mounting portion 31B. That is, the containers 25B, 25C, 25M and 25Y are configured so that they cannot be mounted into the unit mounting portions 31B, 31C, 31M and 31Y without their false mount-inhibiting protrusions 37 being received in the corresponding false mount-inhibiting recesses 58.

Note that the mounting portion-side ribs 54 of the tongue portion 53 are disposed at such locations as not to correspond to (align with) the false mount-inhibiting recesses 58 in the mounting direction in which the containers 25B, 25C, 25M and 25Y are mounted to the unit mounting portions 31B, 31C, 31M and 31Y (a depth direction X from the near side to the far side in FIG. 8). In other words, the locations of the mounting portion-side ribs 54 and the locations of the false mount-inhibiting recesses 58 in the lateral directions Y are different from each other.

Next, operation at the time of mounting the containers 25B, 25C, 25M and 25Y to the unit mounting portions 31B, 31C, 31M and 31Y will be described. Because the containers 25B, 25C, 25M and 25Y can be mounted to the unit mounting portions 31B, 31C, 31M and 31Y by the same method, the operation at the time of mounting the container 25B to the unit mounting portion 31B will be described below as an representative.

When the container 25B is to be mounted to the unit mounting portion 31B, first the opening/closing cover 17 is pivoted from the closed position to the open position, so that the opening/closing cover 17 is in the open state. Subsequently, while a design portion 38-side portion of the container 25B is held by hand, the container 25B is moved along the depth directions X to the insertion opening 32B, with a connecting portion 35-side portion of the container 25B facing and approaching the insertion opening 32B.

At this time, if, due to the weight of the container 25B, the connecting portion 35-side portion of the container 25B should descend and contact the opening/closing cover 17, the connecting portion 35-side portion of the container 25B will slide on the cover-side inclined surfaces 57 of the cover-side ribs 56 that align with the insertion opening 32B in the depth directions X and thus will be guided onto the mounting portion-side inclined surfaces 55 of the mounting portion-side ribs 54 that align with the insertion opening 32B in the depth directions X.

As the container 25B continues to be moved toward the insertion opening 32B, the connecting portion 35-side portion of the container 25B slides on the mounting portion-side inclined surfaces 55 of the mounting portion-side ribs 54 that align with the insertion opening 32B in the depth directions X and thus is guided to the insertion opening 32B. Then, the container 25B is inserted, with its connecting portion 35-side portion first, into the insertion opening 32B. At this time, the three false mount-inhibiting protrusions 37 of the container 25B are inserted into the three corresponding false mount-inhibiting recesses 58 of the unit mounting portion 31B.

Continuously, the unit mounting portion 31B is pushed further into the container 25B so that the container 25B is completely mounted to the unit mounting portion 31B. At this time, the three false mount-inhibiting protrusions 37 of the container 25B are respectively received in the three false mount-inhibiting recesses 58 of the unit mounting portion 31B. Furthermore, at this time, the connecting portion 35 of the container 25B is coupled to the unit mounting portion 31B and communicates with the supply tube 42 that is connected to the unit mounting portion 31B.

Thus, when the container 25B is to be mounted to the unit mounting portion 31B, the container 25B is guided to the insertion opening 32B by the cover-side inclined surfaces 57 and the mounting portion-side inclined surfaces 55 so that the container 25B is smoothly inserted into the insertion opening 32B of the unit mounting portion 31B. In substantially the same manner as described above with the container 25B, the containers 25C, 25M and 25Y are smoothly inserted into the insertion openings 32C, 32M and 32Y to be mounted to the unit mounting portions 31C, 31M and 31Y.

The foregoing exemplary embodiment achieves various advantageous effects as follows.

(1) In the ink jet type printer 11, the mounting portion 26 includes the mounting portion-side ribs 54 that guide the containers 25B, 25C, 25M and 25Y to the insertion openings 32B, 32C, 32M and 32Y when the containers 25B, 25C, 25M and 25Y are to be inserted through the insertion openings 32B, 32C, 32M and 32Y. Therefore, when the containers 25B, 25C, 25M and 25Y are to be mounted to the mounting portion 26, the containers 25B, 25C, 25M and 25Y are guided to the insertion openings 32B, 32C, 32M and 32Y by the mounting portion-side ribs 54. Therefore, the containers 25B, 25C, 25M and 25Y that store the inks, which are print-related members, can be smoothly inserted into the insertion openings 32B, 32C, 32M and 32Y of the mounting portion 26.

(2) In the ink jet type printer 11, each of the mounting portion-side ribs 54 has a mounting portion-side inclined surface 55 that guides a corresponding one of the containers 25B, 25C, 25M and 25Y to a corresponding one of the insertion openings 32B, 32C, 32M and 32Y. Therefore, by sliding the containers 25B, 25C, 25M and 25Y on the mounting portion-side inclined surfaces 55 toward the insertion openings 32B, 32C, 32M and 32Y, the containers 25B, 25C, 25M and 25Y can be smoothly inserted into the insertion openings 32B, 32C, 32M and 32Y of the mounting portion 26.

(3) In the ink jet type printer 11, the mounting portion-side ribs 54 are provided at locations lower than the insertion openings 32B, 32C, 32M and 32Y and the mounting portion-side inclined surfaces 55 of the mounting portion-side ribs 54 are inclined so as to become gradually higher toward the insertion openings 32B, 32C, 32M and 32Y. Therefore, by sliding the containers 25B, 25C, 25M and 25Y on the mounting portion-side inclined surfaces 55 from locations below the insertion openings 32B, 32C, 32M and 32Y toward the insertion openings 32B, 32C, 32M and 32Y, the containers 25B, 25C, 25M and 25Y can be smoothly inserted into the insertion openings 32B, 32C, 32M and 32Y of the mounting portion 26 even when the containers 25B, 25C, 25M and 25Y are heavy.

(4) The ink jet type printer 11 includes a plurality of mounting portion-side ribs 54 that each have a mounting portion-side inclined surface 55. The mounting portion-side ribs 54 can reinforce the mounting portion 26 and guide the containers 25B, 25C, 25M and 25Y by the mounting portion-side inclined surfaces 55 toward the insertion openings 32B, 32C, 32M and 32Y.

(5) In the ink jet type printer 11, the mounting portion 26 is provided with the false mount-inhibiting recesses 58 that receive therein the false mount-inhibiting protrusions 37 of the containers 25B, 25C, 25M and 25Y when the containers 25B, 25C, 25M and 25Y are to be mounted into the insertion openings 32B, 32C, 32M and 32Y. Furthermore, the mounting portion-side ribs 54 are disposed at such locations as not to correspond to (align with) the false mount-inhibiting recesses 58 in the mounting direction (a direction along the depth directions X) in which the containers 25B, 25C, 25M and 25Y are mounted to the mounting portion 26. Therefore, when the containers 25B, 25C, 25M and 25Y are to be mounted to the mounting portion 26, the false mount-inhibiting protrusions 37 of the containers 25B, 25C, 25M and 25Y can be inhibited from colliding with the mounting portion-side ribs 54.

(6) In the ink jet type printer 11, the opening/closing cover 17 has the cover-side inclined surfaces 57 that, during the open state of the opening/closing cover 17, guide the containers 25B, 25C, 25M and 25Y to the mounting portion-side inclined surfaces 55. Therefore, by sliding the containers 25B, 25C, 25M and 25Y on the cover-side inclined surfaces 57 toward the mounting portion-side inclined surfaces 55, the containers 25B, 25C, 25M and 25Y can be guided onto the mounting portion-side inclined surfaces 55.

(7) In the ink jet type printer 11, the opening/closing cover 17 has a plurality of cover-side ribs 56 that each have a cover-side inclined surface 57. Therefore, the cover-side ribs 56 can both reinforce the opening/closing cover 17 and guide by their cover-side inclined surfaces 57 the containers 25B, 25C, 25M and 25Y to the mounting portion-side inclined surfaces 55.

(8) In the ink jet type printer 11, the opening/closing cover 17 is disposed so that, during the open state of the opening/closing cover 17, an end portion thereof at the side in the mounting direction in which the containers 25B, 25C, 25M and 25Y are moved to be mounted to the mounting portion 26 coincides, when viewed in a vertical direction, with the tongue portion 53 that is a portion of the mounting portion 26. Therefore, the distance between the cover-side inclined surfaces 57 and the mounting portion-side inclined surfaces 55 can be made shorter.

(9) In the ink jet type printer 11, the cover-side ribs 56, during the open state of the opening/closing cover 17, are located on an area in the opening/closing cover 17 which is to the side in the direction opposite to the aforementioned mounting direction, with reference to the location of the region A in the opening/closing cover 17 that, when viewed in a vertical direction, coincides with the tongue portion 53. Therefore, the cover-side ribs 56 can be inhibited from contacting the tongue portion 53 when the opening/closing cover 17 is opened and closed.

(10) In the ink jet type printer 11, the opening/closing cover 17 is opened and closed by pivoting the opening/closing cover 17 about the pivot shafts 52. This configuration requires less space than, for example, a configuration in which the opening/closing cover 17 is opened and closed by sliding the opening/closing cover 17 in the lateral directions Y.

(11) In the ink jet type printer 11, the printing section is the liquid discharge head 28 that ejects the inks to the sheet P, and the containers 25B, 25C, 25M and 25Y are liquid storing containers that each include a housing portion 34 that detachably houses a bag 33 that holds an ink that is to be supplied to the liquid discharge head 28. Therefore, by ejecting the inks supplied from the containers 25B, 25C, 25M and 25Y from the liquid discharge head 28 to the sheet P, printing can be carried out on the sheet P.

Modifications

The foregoing exemplary embodiment may be modified as follows.

As illustrated in FIG. 7, an end portion of the opening/closing cover 17 which, during the open state of the opening/closing cover 17, is an opposite side end portion of the upper surface to a mounting portion 26-side portion may be provided with platy ribs 61 each having as an upper surface an inclined surface 60 that is inclined so that the height of the inclined surface 60 increases with increasing distance in the direction (the leftward direction in FIG. 7) in which the containers 25B, 25C, 25M and 25Y are pulled out from the insertion openings 32B, 32C, 32M and 32Y. In this modification, each rib 61 has a substantially right triangle shape when viewed in a lateral direction Y. A plurality of ribs 61 are provided so as to align with (correspond to) the plurality of cover-side ribs 56 in the depth directions X. With this configuration, if the containers 25B, 25C, 25M and 25Y, while being pulled out of the insertion openings 32B, 32C, 32M and 32Y, should contact the opening/closing cover 17, the containers 25B, 25C, 25M and 25Y will slide on the inclined surfaces 60. Because the containers 25B, 25C, 25M and 25Y are guided by the inclined surfaces 60 in a direction of pull-out as mentioned above, the containers 25B, 25C, 25M and 25Y can be smoothly removed from the insertion openings 32B, 32C, 32M and 32Y.

The locations of the false mount-inhibiting recesses 58 provided on the unit mounting portions 31B, 31C, 31M and 31Y may be different from one mounting portion to another. In other words, the locations of the false mount-inhibiting protrusions 37 provided on the containers 25B, 25C, 25M and 25Y may be different from one container to another. In this modification, since the false mount-inhibiting protrusions 37 of each one of the containers 25B, 25C, 25M and 25Y uniquely correspond one-to-one to the false mount-inhibiting recesses 58 of a corresponding one of the unit mounting portions 31B, 31C, 31M and 31Y, it is possible to inhibit each one of the containers 25B, 25C, 25M and 25Y from being mounted to any unit mounting portion other than a corresponding one of the unit mounting portions 31B, 31C, 31M and 31Y. For example, the false mount of the container 25C to the unit mounting portion 31B or the false mount of the container 25M to the unit mounting portion 31Y can be inhibited.

A plurality of mounting portion-side ribs 54 may be provided on the tongue portion 53 over the entire dimension thereof in the lateral directions Y with in-between gaps smaller than the width of the false mount-inhibiting protrusions 37 of the containers 25B, 25C, 25M and 25Y and may generally have a height greater than that of lower ends of the insertion openings 32B, 32C, 32M and 32Y. Furthermore, of the mounting portion-side ribs 54, mounting portion-side ribs 54 provided at locations corresponding to the false mount-inhibiting protrusions 37 of the containers 25B, 25C, 25M and 25Y may have a height less than that of the lower ends of the insertion openings 32B, 32C, 32M and 32Y. In this modification, the mounting portion-side ribs 54 performs substantially the same function as the false mount-inhibiting recesses 58 and therefore can inhibit the false insertion of the containers 25B, 25C, 25M and 25Y into the insertion openings 32B, 32C, 32M and 32Y. In this modification, the sizes of the design portions 38 of the containers 25B, 25C, 25M and 25Y are pre-set so that the design portions 38 do not come into contact with the mounting portion-side ribs 54 when the containers 25B, 25C, 25M and 25Y are inserted into the insertion openings 32B, 32C, 32M and 32Y. Incidentally, of the mounting portion-side ribs 54, the mounting portion-side ribs 54 provided at locations corresponding to the false mount-inhibiting protrusions 37 of the containers 25B, 25C, 25M and 25Y may be omitted.

The mounting portion-side ribs 54 may be omitted and the cover-side ribs 56 may be configured to function as guiding portions. In this modification, it may be advisable that the cover-side ribs 56 be disposed at such locations on the opening/closing cover 17 as to be as close to the insertion openings 32B, 32C, 32M and 32Y as possible when the opening/closing cover 17 is opened.

For example, one of the containers 25B, 25C, 25M and 25Y may be configured to function as a waste liquid tank for collecting waste liquid of inks as examples of a print-related member which is produced due to the printing on the sheet P performed by the liquid discharge head 28. The waste liquid of inks is produced as a result of, for example, a flushing operation in which ink is ejected from the nozzles 45 of the liquid discharge head 28 independently of printing, a cleaning operation in which ink in the liquid discharge head 28 is forced to be ejected from the nozzles 45 by using a suction pump or the like, etc. Alternatively, the mounting portion 26 may be provided with a waste liquid tank-dedicated unit mounting portion separately from the unit mounting portions 31B, 31C, 31M and 31Y, and a waste liquid-collecting container, an example of a container provided separately from the containers 25B, 25C, 25M and 25Y, may be detachably mounted to the waste liquid tank-dedicated unit mounting portion.

The guiding portion may also be a portion that guides the sheet cassette (medium cassette) 18, which is as an example of a container that houses sheets (media) P provided as an example of a print-related member, to the mounting opening 19. In this modification, the casing 12 may be provided with an opening/closing cover that covers the mounting opening 19, which is an example of an opening, in an easily openable/closable manner.

The opening/closing cover 17 does not need to be configured to be opened and closed by pivoting it but may be, for example, configured to be opened and closed by sliding it in the lateral directions Y.

The opening/closing cover 17 does not necessarily need to be disposed so that, during the open state the opening/closing cover 17, an end portion thereof at the side in the mounting direction in which the containers 25B, 25C, 25M and 25Y are mounted to the mounting portion 26 overlaps, when viewed in a vertical direction, the tongue portion 53 that is a portion of the mounting portion 26.

The cover-side ribs 56, during the open state of the opening/closing cover 17, do not necessarily need to be located to a side, in the direction opposite to the mounting direction, from the region A in the opening/closing cover 17 which, when viewed in a vertical direction, coincides with the tongue portion 53.

The opening/closing cover 17 may be provided with only one cover-side rib 56 that has a cover-side inclined surface 57.

The opening/closing cover 17 may be provided without any cover-side rib 56 and, instead, provided with a cover-side inclined surface that, during the open state of the opening/closing cover 17, functions to guide the containers 25B, 25C, 25M and 25Y to the mounting portion-side inclined surfaces 55. In this modification, it may be advisable that the cover-side inclined surface be formed continuously over the entire dimension of the opening/closing cover 17 in the lateral directions Y.

The mounting portion-side ribs 54 do not necessarily need to be disposed at such locations as to align with the false mount-inhibiting recesses 58 in the mounting direction (a direction along the depth directions X) in which the containers 25B, 25C, 25M and 25Y are mounted to the mounting portion 26.

The tongue portion 53 may instead be provided with only one mounting portion-side rib 54 that has a mounting portion-side inclined surface 55.

The mounting portion-side ribs 54 may be omitted from the tongue portion 53 and the tongue portion 53 may instead be provided with an inclined upper surface that functions as a mounting portion-side inclined surface (a guiding portion).

A guiding portion that guides the containers 25B, 25C, 25M and 25Y to the insertion openings 32B, 32C, 32M and 32Y may be disposed above the insertion openings 32B, 32C, 32M and 32Y or at lateral sides thereof.

A guiding portion does not necessarily need to have a mounting portion-side inclined surface 55.

With regard to the unit mounting portions 31B, 31C, 31M and 31Y, the false mount-inhibiting recesses 58 may be omitted.

With regard to the unit mounting portions 31B, 31C, 31M and 31Y, the number and the arrangement of the false mount-inhibiting recesses 58 may be changed as appropriate.

With regard to the containers 25B, 25C, 25M and 25Y, the false mount-inhibiting protrusions 37 may be omitted.

With regard to the containers 25B, 25C, 25M and 25Y, the number and the arrangement of the false mount-inhibiting protrusions 37 may be changed as appropriate.

The opening/closing cover 17 may be omitted.

The mounting portion 26 may be configured so as to receive only one container.

The medium is not limited to sheets P of paper but may also be plastic films or the like.

The printing apparatus may also be a laser printer.

What is claimed is:

1. A printing apparatus comprising:

a printing section that prints on a medium;

a container that houses a print-related member related to printing performed by the printing section; and a mounting portion which has an opening, wherein the container is inserted through the opening and is detachably mounted to the mounting portion after being inserted through the opening, wherein the mounting portion includes a guiding portion that has a mounting portion-side inclined surface that guides the container to the opening when the container is inserted through the opening, wherein the guiding portion is positioned in front of and below the opening such that the guiding portion guides the container to the opening before the container enters the opening.

2. The printing apparatus according to claim 1, wherein the guiding portion is disposed at such a location corresponding to the opening in a lateral direction of the printing apparatus as to guide the container to the opening.

3. The printing apparatus according to claim 1, wherein the mounting portion-side inclined surface is inclined so as to become higher toward the opening.

4. The printing apparatus according to claim 1, wherein the guiding portion has, corresponding to the opening, at least one mounting portion-side rib that has the mounting portion-side inclined surface.

5. The printing apparatus according to claim 4, wherein the container includes a false mount-inhibiting protrusion that inhibits false mounting to the mounting portion, and wherein the mounting portion includes a false mount-inhibiting recess portion that receives the false mount-inhibiting protrusion when the container is mounted to the mounting portion, and wherein the mounting portion-side rib is disposed at such a location as not to correspond to the false mount-inhibiting recess portion in a mounting direction in which the container is mounted to the mounting portion.

6. The printing apparatus according to claim 5, wherein the mounting portion includes a plurality of unit mounting portions, and wherein locations of the false mount-inhibiting recess portions provided for the plurality of unit mounting portions are different from one unit mounting portion to another.

7. The printing apparatus according to claim 1, further comprising an opening/closing cover that covers the mounting portion in an easily openable/closable manner, wherein the opening/closing cover has a cover-side inclined surface that, during an open state of the opening/closing cover, guides the container to the mounting portion-side inclined surface.

8. The printing apparatus according to claim 4, further comprising an opening/closing cover that covers the mounting portion in an easily openable/closable manner, wherein the opening/closing cover has, for the opening, at least one cover-side rib that has the cover-side inclined surface that, during an open state of the opening/closing cover, guides the container to the mounting portion-side inclined surface, and wherein the mounting portion-side rib and the cover-side rib disposed at the same location in a lateral direction of the printing apparatus and the mounting portion-side rib and the cover-side rib together guide the container to the opening.

9. The printing apparatus according to claim 8, wherein the opening/closing cover is disposed so that, during the open state of the opening/closing cover, an end portion of the opening/closing cover at a side in a mounting direction in which the container is mounted to the mounting portion overlaps a portion of the mounting portion when viewed in a vertical direction.

10. The printing apparatus according to claim 9, wherein during the open state of the opening/closing cover, the cover-side rib is located at a side in a direction opposite to the mounting direction from a portion of the opening/closing cover which, when viewed in the vertical direction, coincides with a portion of the mounting portion.

11. The printing apparatus according to claim 10, wherein the opening/closing cover is opened and closed by pivoting the opening/closing cover about a pivot shaft.

12. The printing apparatus according to claim 1, further comprising an opening/closing cover that covers the mounting portion in an easily openable/closable manner, wherein an end-side portion of the opening/closing cover which, during an open state of the opening/closing cover, is an end-side portion in a direction opposite to the mounting direction of the container has a second cover-side inclined surface that becomes higher toward an end of the opening/closing cover in the direction opposite to the mounting direction.

13. The printing apparatus according to claim 1, wherein the printing section is a liquid discharge head that ejects a liquid to the medium, and wherein the container is a liquid storing container that includes a housing portion that detachably houses a liquid container that stores the liquid that is to be supplied to the liquid discharge head.

14. A printing apparatus comprising:

a printing section that prints on a medium;

a container that houses a print-related member related to printing performed by the printing section;

a mounting portion which has an opening, wherein the container is inserted through the opening and is detachably mounted to the mounting portion after being inserted through the opening; and an opening/closing cover that covers the mounting portion in an easily openable/closable manner, wherein the mounting portion includes a mounting-side guiding portion that includes an inclined surface and the opening/closing cover includes a cover-side guiding portion that has an inclined surface, wherein, when the container is to be inserted through the opening the mounting-side guiding portion and the cover-side guiding portion guide the container to the opening, wherein the mounting-side guiding portion is positioned in front of and below the opening.

15. A printing apparatus comprising:

a printing section that prints on a medium;

a container that houses a print-related member related to printing performed by the printing section, wherein the container includes a false mount-inhibiting protrusion that inhibits false mounting to the mounting portion; and a mounting portion which has an opening, wherein the container is inserted through the opening and is detachably mounted to the mounting portion after being inserted through the opening, wherein the mounting portion includes a guiding portion that has a mounting portion-side inclined surface that guides the container to the opening when the container is inserted through the opening, wherein the guiding portion includes, corresponding to the opening, at least one mounting portion-side rib that includes the mounting-side inclined surface, wherein the mounting portion includes a false mount-inhibiting recess portion that receives the false mount-inhibiting protrusion when the container is mounted to the mounting portion, and wherein the mounting portion-side rib is disposed at such a location as not to correspond to the false mount-inhibiting recess portion in a mounting direction in which the container is mounted to the mounting portion.

16. A printing apparatus comprising:

a printing section that prints on a medium;

a container that houses a print-related member related to printing performed by the printing section, wherein the container includes a false mount-inhibiting protrusion that inhibits false mounting to the mounting portion;

a mounting portion which has an opening, wherein the container is inserted through the opening and is detachably mounted to the mounting portion after being inserted through the opening; and an opening/closing cover that covers the mounting portion in an openable/closable manner, wherein at least one of the mounting portion and the opening/closing cover includes a guiding portion that has an inclined surface, wherein, when the container is to be inserted through the opening, the guiding portion guides the container to the opening, wherein the mounting portion includes a false mount-inhibiting recess portion that receives the false mount-inhibiting protrusion when the container is mounted to the mounting portion, and wherein the mounting portion-side rib is disposed at such a location as not to correspond to the false mount-inhibiting recess portion in a mounting direction in which the container is mounted to the mounting portion.

17. A printing apparatus comprising:

a printing section that prints on a medium;

a container that houses a print-related member related to printing performed by the printing section; and a mounting portion which has an opening, wherein the container is inserted through the opening and is detachably mounted to the mounting portion after being inserted through the opening, wherein the mounting portion includes a guiding portion that has a mounting portion-side inclined surface that guides the container to the opening when the container is inserted through the opening, wherein the guiding portion includes, corresponding to the opening, at least one mounting portion-side rib that includes the mounting-side inclined surface, an opening/closing cover that covers the mounting portion in an openable/closable manner, wherein the opening/closing cover has, for the opening, at least one cover-side rib that has the cover-side inclined surface that, during an open state of the opening/closing cover, guides the container to the mounting portion-side inclined surface, and wherein the mounting portion-side rib and the cover-side rib disposed at the same location in a lateral direction of the printing apparatus and the mounting portion-side rib and the cover-side rib together guide the container to the opening.

18. A printing apparatus comprising:

a printing section that prints on a medium;

a container that houses a print-related member related to printing performed by the printing section;

a mounting portion which has an opening, wherein the container is inserted through the opening and is detachably mounted to the mounting portion after being inserted through the opening; and an opening/closing cover that covers the mounting portion in an openable/closable manner, wherein at least one of the mounting portion and the opening/closing cover includes a guiding portion that has an inclined surface, wherein, when the container is to be inserted through the opening, the guiding portion guides the container to the opening, wherein the opening/closing cover has, for the opening, at least one cover-side rib that has the cover-side inclined surface that, during an open state of the opening/closing cover, guides the container to the mounting portion-side inclined surface, and wherein the mounting portion-side rib and the cover-side rib disposed at the same location in a lateral direction of the printing apparatus and the mounting portion-side rib and the cover-side rib together guide the container to the opening.

* * * * *